US006149409A

United States Patent [19]

Palakodati et al.

[11] Patent Number: 6,149,409

[45] Date of Patent: Nov. 21, 2000

[54] CARTRIDGE VANE PUMP WITH DUAL SIDE FLUID FEED AND SINGLE SIDE INLET

[75] Inventors: Sunil Palakodati, Westland; Ronald Theis, Redford Township, both of Mich.

[73] Assignee: Ford Global Technologies, Inc., Dearborn, Mich.

[21] Appl. No.: 09/366,096

[22] Filed: Aug. 2, 1999

[51] Int. Cl.[7] ..... F03C 2/00

[52] U.S. Cl. ..... 418/15; 418/259; 418/133

[58] Field of Search ..... 418/15, 259, 133

[56] References Cited

U.S. PATENT DOCUMENTS

| | | | |
|---|---|---|---|
| 2,228,933 | 10/1941 | Thomson | 418/15 |
| 2,232,983 | 2/1941 | Wahlmark | 418/15 |
| 2,291,346 | 7/1942 | Robinson . | |
| 3,870,910 | 3/1975 | Füssner . | |
| 3,877,845 | 4/1975 | Green . | |
| 4,002,029 | 1/1977 | Jones . | |
| 4,500,270 | 2/1985 | Tuckey . | |
| 4,502,854 | 3/1985 | Shibuya et al. | 418/15 |
| 4,596,519 | 6/1986 | Tuckey . | |
| 4,778,354 | 10/1988 | Idei . | |
| 4,986,739 | 1/1991 | Child | 418/15 |
| 5,064,362 | 11/1991 | Hansen | 418/15 |
| 5,112,085 | 5/1992 | Busch . | |
| 5,593,287 | 1/1997 | Sadakata . | |
| 6,030,191 | 2/2000 | Wood et al. | 418/15 |

FOREIGN PATENT DOCUMENTS

| | | | |
|---|---|---|---|
| 58-0197494 | 11/1983 | Japan | 418/15 |

*Primary Examiner*—Thomas Denion
*Assistant Examiner*—Theresa Trieu

[57] ABSTRACT

A hydraulic vane pump (10), including a top section (12), a middle section (14), a vane rotor assembly (16) and a bottom section (18) secured together to form a single assembly. The vane pump (10) has a fluid feed chamber (20) to supply fluid directly to the top of a bore (32) formed in the middle section (14). Fluid from the feed chamber (20) also passes through a bypass chamber (28) into a fluid pocket (24) in the bottom section (18) and into the bottom of the bore (32). A vane rotor assembly (16) is used to force fluid from the bore (32) out the outlet chamber (26). By supplying fluid to both the top and bottom of the bore (32) cavitation is reduced. By feeding fluid from a single side of the hydraulic vane pump (10), packaging requirements are minimized.

18 Claims, 2 Drawing Sheets

CARTRIDGE VANE PUMP WITH DUAL SIDE FLUID FEED AND SINGLE SIDE INLET

TECHNICAL FIELD

The present invention relates generally to vane pumps and more particularly, to hydraulic vane pumps for power steering systems which minimize cavitation.

BACKGROUND ART

The use of hydraulic pumps, such as power steering pumps, is well known in the automotive industry. Power steering systems use pumps to provide hydraulic fluid to the steering system. Conventional hydraulic pumps are typically positive displacement pumps, such as vane pumps. The operational performance of the power steering system is dependent on a reliable and consistent flow output from these pumps.

The reliability and consistency of flow through hydraulic pumps is affected by cavitation of the fluid passing through the pump. Cavitation can cause undesired noise and erosive wear of the pump. It can also cause pump failure.

Current design solutions to counter cavitation include feeding fluid from multiple sides of the pump, using several staged pumps, or using cams to reduce flow into the pump. These solutions have significant disadvantages when viewed in conjunction with the tight packaging conditions presented in modern vehicle design. Current designs require more space or specialized packaging designs that are often not available.

Therefore, there is a need for a design that is effective in reducing cavitation, and the noise and adverse affects associated with it, while at the same time minimizing packaging requirements.

SUMMARY OF THE INVENTION

It is an object of the present invention to provide a hydraulic vane pump that is effective in reducing cavitation. It is another object of the present invention to provide a hydraulic vane pump that minimizes packaging considerations.

In accordance with the objects of the present invention a hydraulic vane pump is provided. The pump contains a top section, a bottom section, and a middle section (also referred to as a "cam ring") disposed between the top and bottom sections. These sections may be formed individually or in various combinations to make up a single unit. A vane rotor assembly is positioned in a bore located in the cam ring. The vane rotor assembly and bore may be in any combination of shapes that facilitate a pumping action upon rotation of the vane rotor assembly. Commonly, the vane rotor assembly will be cylindrical in nature and the bore will be elliptical in nature. A shaft passes through the center of the hydraulic vane pump and the center of the vane rotor assembly. The shaft mates with the vane rotor assembly to impart rotational drive to the vane rotor assembly.

The top section of the pump contains one or more fluid feed chambers. The bottom section of the pump contains one or more fluid pockets and outlet chambers. The middle section of the pump contains a corresponding number of bypass chambers. The middle section of the pump also contains a bore that houses the vane rotor assembly.

The elements of the pump are arranged such that fluid entering the pump flows through the fluid feed chamber(s) into both the top of the bore and the fluid bypass chamber(s). Fluid passes from the fluid bypass chamber(s) through the fluid pocket(s) and into the bottom of the bore. In this way, fluid entering from a single side of the pump is supplied to the bore where the vane rotor assembly is housed, from both the top and bottom of the bore.

As the vane rotor assembly is rotated by the shaft, the vanes force the fluid located within the bore out through the outlet chamber(s). Through the process of feeding fluid from a single source into both the top and the bottom of the bore, the present invention reduces cavitation that would normally be produced by feeding the fluid from only one side of a bore and eliminates the packaging restraints associated with feeding fluid into the top and bottom of the bore from fluid inlet sources on both the top and bottom of the pump.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
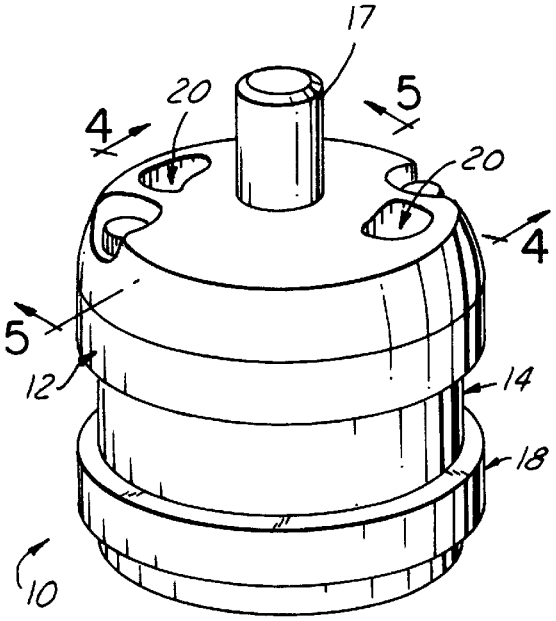
FIG. 1 is a schematic view of a hydraulic vane pump in accordance with a preferred embodiment of the present invention.
Figure 3:
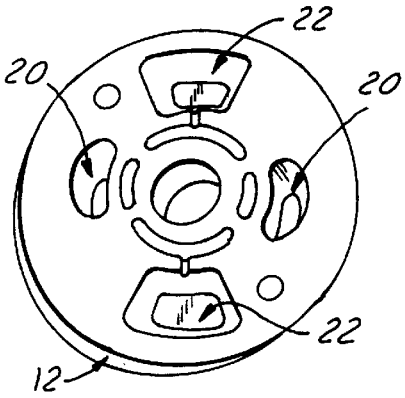
FIG. 3 is a bottom view of the top section of the hydraulic vane pump of FIG. 1.
Figure 2:
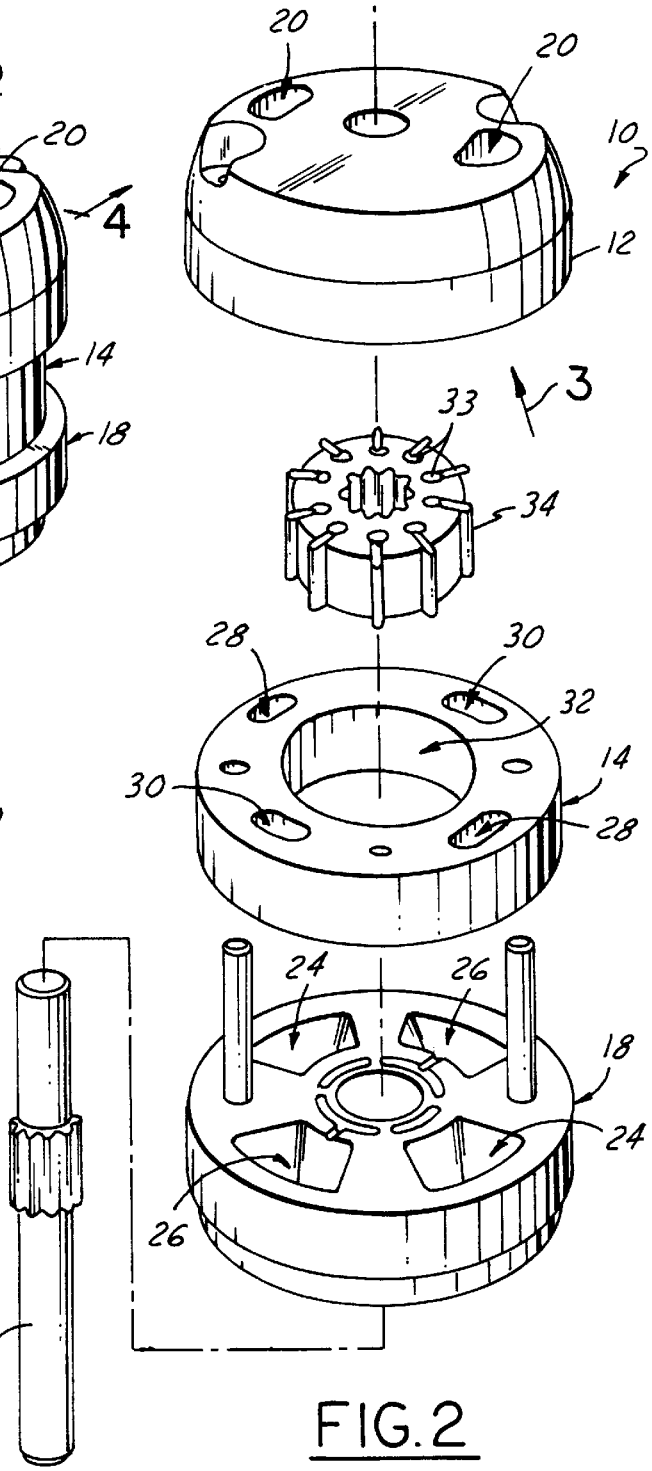
FIG. 2 is a schematic exploded view of the hydraulic vane pump illustrated in FIG. 1.
Figure 4:
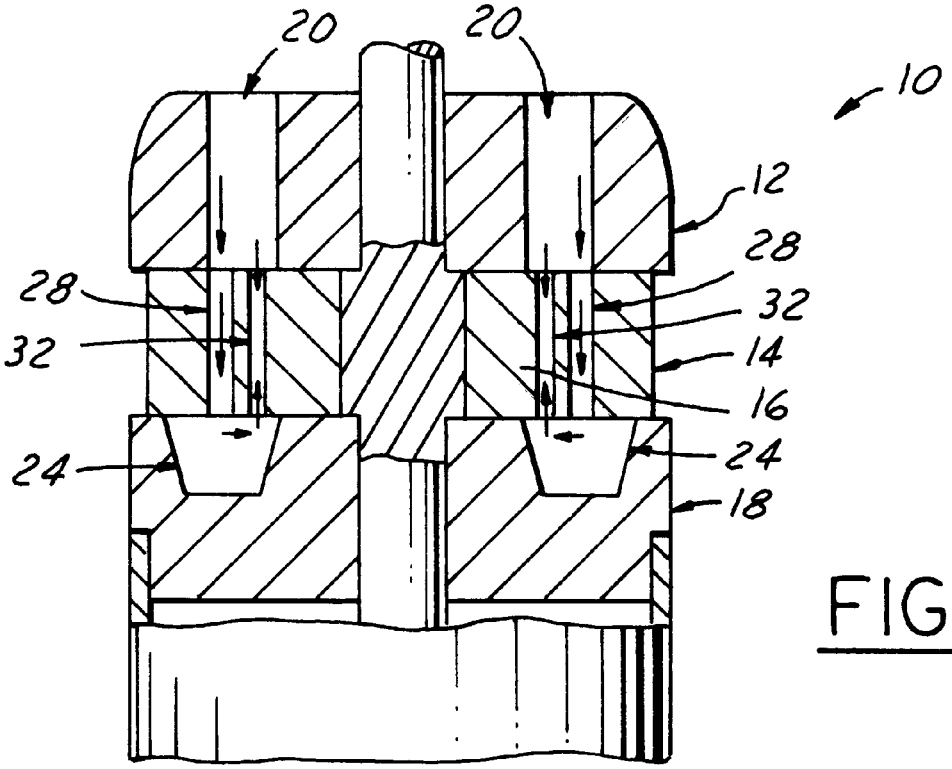
FIG. 4 is a cross-sectional view of the hydraulic vane pump of FIG. 1, the cross-section being taken along line 4—4 in FIG. 1 and in the direction of the arrows.

FIGS. 1 through 5 illustrate a preferred embodiment of the invention. It is to be understood, however, that the present invention is not limited to the structure or configuration of elements depicted and that other structures and configurations can be utilized within the scope and meaning of the present invention.

FIGS. 1 through 5, illustrate a hydraulic vane pump 10 in accordance with a preferred embodiment of the present invention. The hydraulic vane pump 10 includes a top section 12, a middle section 14, a vane rotor assembly 16, a shaft 17 and a bottom section 18. The middle section is also referred to as a "cam ring". Although the two end sections are referred to as the "top" and "bottom" sections, it is to be understood that this is merely for convenience and ease of describing the structure, and that the pump 12 can be utilized in any orientation.

Each of the sections contain two pairs of openings or apertures arranged around a central opening. Specifically, the top section 12 contains two fluid feed chambers 20 and two counter balance pressure wells 22 (best viewed in FIG. 3). The bottom section 18 contains two fluid pockets 24 and two fluid outlet chambers 26. The middle section 14 contains two fluid bypass chambers 28, two counter-balance pressure ports 30 and a centrally located oval shaped bore 32. A cylindrical vane rotor assembly 16 is located in the bore 32. A shaft 17 passes through the center of the hydraulic vane pump 10 and the center of the vane rotor assembly 16 imparting rotational drive to the vane rotor assembly 16.

The vane rotor assembly 16 is preferably cylindrical with a plurality of slots 33 formed radially around its circumference. Vanes 34 are located in each of the slots 33. The vanes 34 move radially in the slots with respect to the periphery of the rotor 16. As the shaft 17 spins, the vane rotor assembly 16 is rotated within the elliptical bore 32 and the vanes 34 extend outwardly to maintain constant contact with the surface of the bore 32.

The three sections are positioned in the configuration and orientations shown in FIGS. 1 through 5 with the chambers and wells in axial alignment. In operation, fluid enters the hydraulic vane pump 10 through fluid feed chambers 20. Fluid from the feed chambers 20 then passes into both the top of the oval shaped bore 32 and through the fluid bypass chambers 28 simultaneously. Fluid from the bypass chambers 28 passes into fluid pockets 24 formed in the bottom section 18 and then is deflected into the bottom of the oval shaped bore 32. This flow path is illustrated by the arrows depicted in the cross-sectional view of the invention as set forth in FIG. 4.

In this configuration, the bore 32 is supplied with hydraulic fluid from both the top and the bottom sides. This reduces the cavitation that can occur when fluid is supplied to the vane rotor assembly 16 only from the top of the bore 32.

Figure 5:
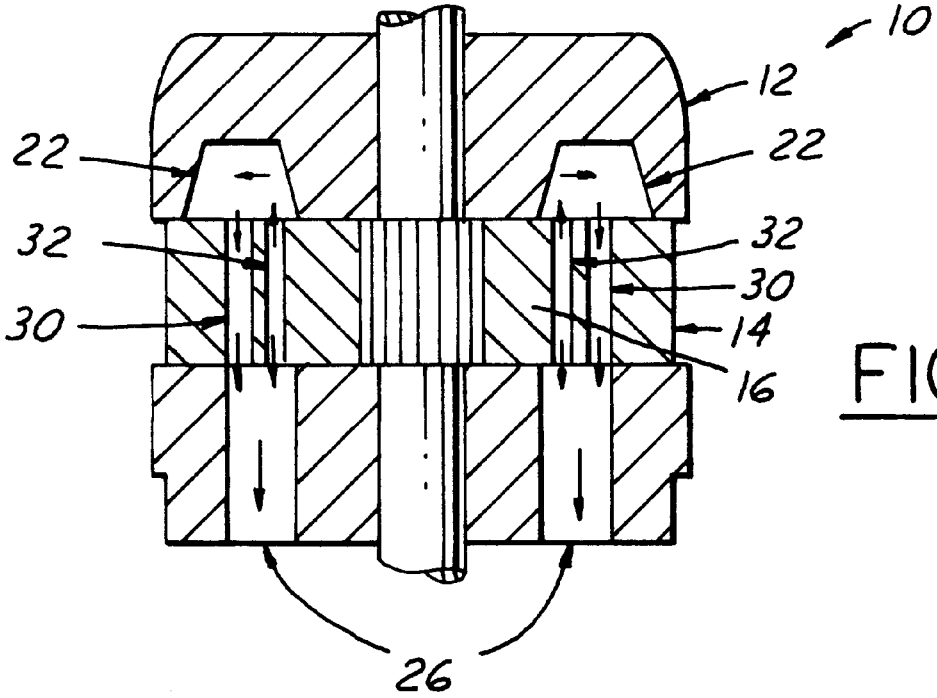
FIG. 5 is a cross-sectional view of the hydraulic vane pump of FIG. 1, the cross-section being taken along line 5—5 in FIG. 1 and in the direction of the arrows.

FIG. 5, which is another cross-sectional view of the hydraulic pump 10 shown in FIG. 1, illustrates fluid flow from the bore 32. As the cylindrical vane rotor assembly 16 is rotated within the oval bore 32, the vanes 34 force fluid from within the oval bore 32 into the fluid outlet chambers 26 formed through the bottom section. Fluid is also forced out of the top of the bore 32 into the counter-balance pressure wells 22 formed in the top section. Fluid in the counter balance pressure wells 22 flows through the counter balance pressure ports 30 in the cam ring and into the fluid outlet chambers 26 formed in the bottom section.

The overall result is a hydraulic vane pump with significant reductions in cavitation. The reduction in cavitation makes this pump quieter than present pumps and more durable. Also, sudden changes in pressure of the fluid in the outlet chambers are reduced.

The fluid inlets on the hydraulic vane pump 10 are only located on one face of the pump. While it is shown formed in the top section, it can also be formed in the bottom section with the remaining components of the pump being designed accordingly. This allows more flexibility in design packaging applications than standard designs. The reduction in cavitation combined with the increased flexibility in design applications makes this hydraulic vane pump 10 an advancement over existing vane pump designs.

While particular embodiments of the invention have been shown and described, numerous variations and alternate embodiments will occur to those skilled in the art. Accordingly, it is intended that the invention be limited only in terms of the appended claims.

What is claimed is:

1. A vane pump comprising:

a top section, a bottom section, and a middle section disposed between said top section and said bottom section;

a vane rotor assembly positioned in a bore located in said middle section, said middle section bore having a top opening and a bottom opening;

at least one bypass chamber formed in said middle section;

at least one fluid feed chamber formed in said top section, said fluid feed chamber being partially aligned with said bore to allow fluid to flow into said top opening of said bore, and being partially aligned with said at least one bypass chamber to allow fluid to flow into said at least one bypass chamber;

at least one fluid pocket formed in said bottom section for receiving fluid from said at least one bypass chamber, said fluid pocket being partially aligned with said at least one bypass chamber and being partially aligned with said bottom opening of said bore to allow fluid to flow into said bottom opening of said bore from said at least one bypass chamber;

at least one fluid outlet chamber formed in said bottom section and being at least partially aligned with said bore to allow fluid to flow into said at least one fluid outlet chamber from said bore and out the bottom section;

wherein said at least one fluid feed chamber is positioned to allow fluid to flow into said top opening of said bore and simultaneously into said at least one bypass chamber continuing though to said at least one fluid pocket and said bottom opening of said bore; and wherein fluid is supplied to said vane rotor assembly through both said top opening and said bottom opening of said bore whereby cavitation is reduced.

2. A vane pump as described in claim 1, further comprising two fluid inlet chambers, two fluid bypass chambers, two fluid pockets, and two fluid outlet chambers.

3. A vane pump as described in claim 1, wherein the vane pump is incorporated into an automobile.

4. A vane pump as described in claim 1, wherein the vane pump is incorporated into an automotive power steering application.

5. A vane pump as described in claim 1, wherein said top section and said middle section are formed as a single integral piece.

6. A vane pump as described in claim 1, wherein said bottom section and said middle section are formed as a single integral piece.

7. A vane pump as described in claim 1, wherein said bore is elliptical and said vane rotor assembly is cylindrical.

8. A vane pump as described in claim 1 further comprising:

at least one counter balance pressure port formed in said middle section; and at least one counter balance pressure well formed in said top section and positioned to allow fluid to flow from said top opening of said bore into communication with said at least one counter balance pressure port and out said at least one outlet chamber.

9. A vane pump as described in claim 8, wherein said vane pump includes two fluid inlet chambers, two fluid bypass chambers, two fluid pockets, two fluid outlet chambers, two counter balance pressure ports, and two counter balance pressure wells.

10. A vane pump comprising:

a top section, a bottom section, and a middle section disposed between said top section and said bottom section;

a vane rotor assembly positioned in a bore located in said middle section, said middle section bore having a top opening and a bottom opening;

at least one bypass chamber formed in said middle section;

at least one fluid feed chamber formed in said top section, said fluid feed chamber in fluid communication with both said bore and said at least one bypass chamber to allow fluid to flow simultaneously into said top opening of said bore and said at least one bypass chamber;

at least one fluid pocket formed in said bottom section and in fluid communication with both said at least one bypass chamber and said bottom opening of said bore to allow fluid to flow into said bottom opening of said bore from said at least one bypass chamber;

at least one fluid outlet chamber formed in said top section and being at least partially aligned with said bore to allow fluid to flow into said at least one fluid outlet chamber from said bore and out said top section;

wherein said at least one fluid feed chamber is positioned to allow fluid to flow into said top opening of said bore and simultaneously into said at least one bypass chamber continuing though to said at least one fluid pocket and said bottom opening of said bore; and wherein fluid is supplied to said vane rotor assembly through both said top opening and said bottom opening of said bore whereby cavitation is reduced.

11. A vane pump as described in claim 10, further comprising two fluid inlet chambers, two fluid bypass chambers, two fluid pockets, and two fluid outlet chambers.

12. A vane pump as described in claim 10, wherein the vane pump is incorporated into an automobile.

13. A vane pump as described in claim 10, wherein the vane pump is incorporated into an automotive power steering application.

14. A vane pump as described in claim 10, wherein said top section and said middle section are formed as a single integral piece.

15. A vane pump as described in claim 10, wherein said bottom section and said middle section are formed as a single integral piece.

16. A vane pump as described in claim 10, wherein said bore is elliptical and said vane rotor assembly is cylindrical.

17. A vane pump as described in claim 10 further comprising:

at least one counter balance pressure port formed in said middle section; and at least one counter balance pressure well formed in said bottom section and positioned to allow fluid to flow from said bottom opening of said bore into communication with said at least one counter balance pressure port and out said at least one outlet chamber.

18. A vane pump as described in claim 17, wherein said vane pump includes two fluid inlet chambers, two fluid bypass chambers, two fluid pockets, two fluid outlet chambers, two counter balance pressure ports, and two counter balance pressure wells.

* * * * *